US006349897B1

(12) United States Patent
Sinkko et al.

(10) Patent No.: US 6,349,897 B1
(45) Date of Patent: Feb. 26, 2002

(54) DEVICE IN WINDING OF A WEB

(75) Inventors: Jari Sinkko; Jarmo Malmi; Pauli Koutonen, all of Järvenpää (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/424,968

(22) PCT Filed: Jun. 1, 1998

(86) PCT No.: PCT/FI98/00462

§ 371 Date: Dec. 3, 1999

§ 102(e) Date: Dec. 3, 1999

(87) PCT Pub. No.: WO98/55383

PCT Pub. Date: Dec. 10, 1998

(30) Foreign Application Priority Data

Jun. 3, 1997 (FI) ..... 972352

(51) Int. Cl.[7] ..... B65H 18/14
(52) U.S. Cl. ..... 242/541.5
(58) Field of Search ..... 242/520, 540, 242/541, 541.5, 541.6

(56) References Cited

U.S. PATENT DOCUMENTS 4,932,599 A 6/1990 Doerfel ..... 242/56.4

FOREIGN PATENT DOCUMENTS

| | | | |
|---|---|---|---|
| DE | 3737503 | 5/1989 | ..... B65H/19/30 |
| DE | 3918520 | 12/1990 | ..... B65H/18/16 |
| EP | 0292451 | 11/1988 | ..... B65H/18/20 |
| WO | 9532908 | 12/1995 | ..... B65H/18/14 |

*Primary Examiner*—Donald P. Walsh
*Assistant Examiner*—Mark J. Beauchaine
(74) *Attorney, Agent, or Firm*—Steinberg & Raskin

(57) ABSTRACT

The invention concerns a device in winding of a web. The device is composed of at least one loading and/or support unit (24) in order to support the winding core and to load the roll. The loading and/or support unit (24) comprises at least two rolls (22), around which at least one belt (25) has been fitted in the axial direction of the rolls (22). The rolls (22) in the loading and/or support unit (24) have been coupled together by means of coupling members (53, 54) so that movements of the rolls (22) in relation to one another are geometrically positively controlled.

13 Claims, 3 Drawing Sheets

DEVICE IN WINDING OF A WEB

FIELD OF THE INVENTION

The present invention relates to a device for supporting a spool in a paper or board making machine.

BACKGROUND OF THE INVENTION

With respect to the prior art related to the present invention, reference can be made to the applicant's FI Patent Application 942451, in which a method and a device in winding of a web are described. The device that carries out this prior-art method has been fitted to be used when a web is wound onto a spool on support of a support roll while the web is passed through a nip formed between the support roll and the roll that is being produced, which spool is at least partly supported by means of a support device fitted in the centre of the spool, which device comprises a unit for supporting the spool and for loading the roll. In this prior-art solution the unit has been fitted as a combined loading/supporting and surface-drive member, and the device comprises means for shifting the unit substantially in a plane passing through the axes of the support roll and of the roll that is being produced as a linear movement and substantially along a curved path in the direction of the circumference of the roll.

With respect to the prior art related to the present invention, reference can also be made to the published EP patent application 292 451, which discloses a belt support unit including belt rolls, around which a carrier belt is fitted. The support unit supports the roll being formed from below at least in the final stages of reeling by extending a belt zone and, at the same time, by adjusting the tension of the carrier belt so that the linear loads in various supporting nips of the roll being produced remain within suitable limit values. According to the publication, the extending of the belt zone and the adjusting of the tension of the carrier belt are accomplished by means of one power cylinder fitted between the belt rolls, and further the support assembly for the belt rolls is accomplished by means of a rhomboid actuated by a second power cylinder.

With respect to the prior art related to the present invention, reference can also be made to the published DE Patent Application 3737503, in which a rigid rider roll unit connected with a reel slitter machine is described. In this prior-art arrangement, bending of the spool at the beginning of winding cannot be prevented, and therefore bending of the spool may cause problems of winding.

With respect to the prior art, reference is also made to the DE Patent 391852, in which a device is described for winding of a material web, in connection with which device, when the web tension bends the spool, the spool is kept straight by pushing by means of a cylinder, which also moves the rider roll head. By means of this arrangement, it is also possible to bend the spool in the opposite direction in order to produce an effect of spreading the web. It is a drawback in this prior-art arrangement that the rolls are stationary in relation to one another, in which case a belt that would improve the friction and distribute the load more evenly cannot be fitted around said rolls, because the belt cannot be tensioned. By means of a belt, the friction coefficient between the roll and the rider rolls can be increased to a considerable extent, and the force applied by the rider roll to the roll in the radial direction of the roll can be distributed more evenly over a wider area. These factors have a great importance for the quality of the roll to be wound, and by means of a belt it is possible to widen the range of application of various winding parameters considerably, in which connection it is better possible to meet the requirements that are imposed by different paper grades on winding that produces good rolls.

OBJECTS AND SUMMARY OF THE INVENTION

The bending of the spool at the beginning of winding arises from a tensile strain present in the web in the longitudinal direction of the web, which strain has the effect that the spool is bent into curve form between its ends and is, thus, not fitted as straight in relation to the cylinder, in which case the winding nip also becomes curved and, thus, problems of winding arise.

An object of the present invention is further development of the solution described in the applicant's FI Patent Application 942451 mentioned above so that the spool cannot be bent at the beginning., of winding, in which case the spool cannot cause problems in the winding either.

It is a further object to provide a rider roll construction in which it is possible to provide the rider rolls with a drive in order to load the face of the roll in the direction of its circumference. In this way it is, among other things, possible to regulate the tightness of winding.

It is a particular object of the invention to provide a rider roll construction in which an endless belt/belts can be fitted around at least two rider rolls, whereat the tension of these belts can be regulated by varying, the distance between the rolls, and which rider roll construction is capable of transferring forces to the spool and/or roll both in the direction of their radius and in the direction of their circumference.

The arrangement in accordance with the invention consists of a rider roll unit, which supports the spool during winding and, at the same time, prevents bending of the spool during winding. The rider roll unit comprises rolls, around which a belt runs. The rolls in the rider roll unit have been coupled together by means of coupling members so that movements of the rolls in relation to one another are geometrically positively controlled. In a preferred embodiment in accordance with the invention, the relative movements of the rolls take place so that a geometrically controlled, symmetric movement is produced in relation to the central axis of the rider roll unit. Then, the winding gap formed between the rolls of the rider roll unit remains stationary, in which connection the spool remains straight at the beginning of winding.

The arrangement in accordance with the invention is suitable for use in particular in connection with wide rolls, in which, thus, long spools are used, which are highly susceptible of bending. The arrangement in accordance with the invention can be provided with a drive motor, in which case, by means of the arrangement in accordance with the invention, the rolls can be loaded in the direction of the circumference, by which means it is possible to affect the quality of the rolls that are being produced to a great extent.

BRIEF DESCRIPTION OF THE DRAWINGS

In the following, the invention will be described in more detail with reference to the figures in the accompanying drawing, the invention being by no means supposed to be strktly confined to the details of said illustrations.

DETAILED DESCRIPTION OF THE INVENTION

Figure 1:
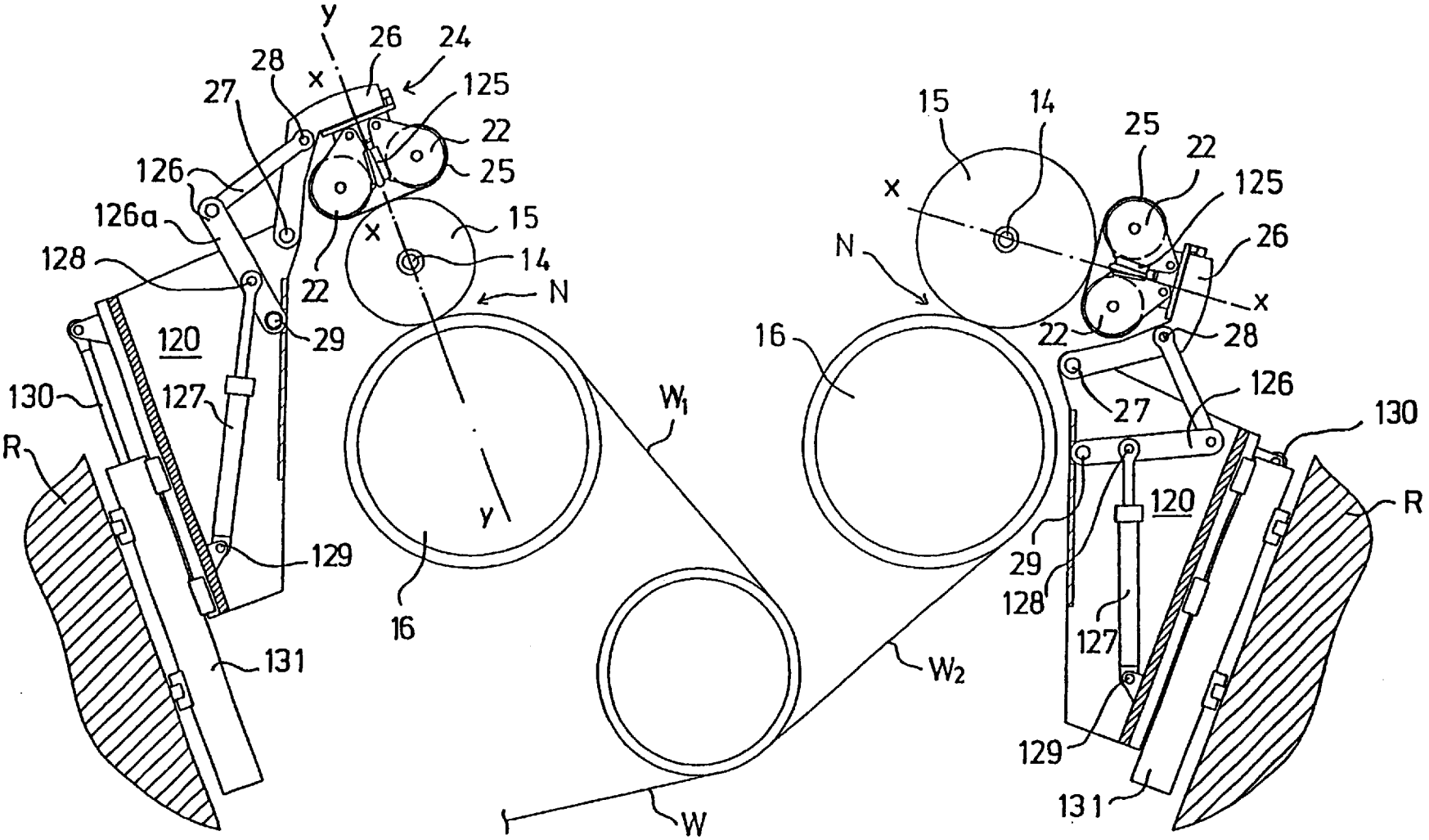
FIG. 1 is a schematic vertical sectional view of an exemplifying embodiment of the invention.

FIG. 1 shows an exemplifying embodiment in which the web W is wound by means of a what is called centre-drive winder. The web W, for example a paper or board web, is wound by means of a support roll 16 around a spool 14 to make a web roll 15, the web passing through the nip N formed between the support roll 16 and the roll 15 that is being produced. The spool 14 is connected with the other constructions of the winder in compliance with the centre-drive winder technique in itself known to a person skilled in the art (not shown in the illustration). The figure illustrates the winding of a web W onto two rolls 15 by means of two support rolls 16 in a winder device. In view of illustrating the operation of the rider roll device 24, the rolls 15 on the different support rolls 16 have been illustrated as being in different winding stages. Thus, the web W comes from the machine reel as slit component webs $W_1$, $W_2$, of which every second component web $W_1$ is wound by means of the winder placed at the left side in the figure, and every second component web $W_2$ is wound by means of the winder placed at the right side in the figure. The closer details of the device and its principle of operation come out from the applicant's said FI Patent Application 942451.

As is shown in FIG. 1, the rider roll support unit, i.e. the combined loading and/or support unit 24, consists of two rolls 22, around which an endless belt/belts 25 has/have been fitted running. One or both of the rolls 22 has/have been coupled in engagement with a drive in order to rotate the rolls 22 and the belt 25. Between the rolls 22, a bellows 125 is fitted (FIG. 2), by whose means the mutual distance of the rolls 22 and thereby the tension of the belt/belts 25 are regulated.

The support construction 26 of the loading and/or support unit 24 is attached to a sledge unit 120 by means of an articulated joint 27. Further, the support construction 26 is connected with the sledge construction 120 by means of an articulated support arm 126, one of whose ends is connected to the support construction 26 by means of an articulated joint 28, and the other end to the sledge construction 120 by means of an articulated joint 29. To the articulated support arm 126, to its part **126*a* placed next to the sledge construction 120, a loading cylinder 127 is connected by means of an articulated joint 128. The opposite end of the loading cylinder 127 is connected to the sledge construction 120 by means of an articulated joint 129. By means of the loading cylinders 127 and 130, it is possible to displace the loading and/or support unit 24 along a path parallel to the circumference of the roll 15. By means of the loading cylinder 127, the desired loading and/or support is also provided for the roll 15. The sledge construction 120 can be displaced in the direction of growth of the roll 15, i.e. in the direction of the straight line Y—Y passing through the centre of the support roll 16, through the centre of the roll 15, and through the centre point of the straight line between the centres of the rolls 22 in the loading and/or support unit 24, by means of the cylinder 130. The sledge construction 120 is attached to an auxiliary sledge 131 as sliding, which auxiliary sledge 131** is again attached to the frame R of the winding device.

Figure 2A:
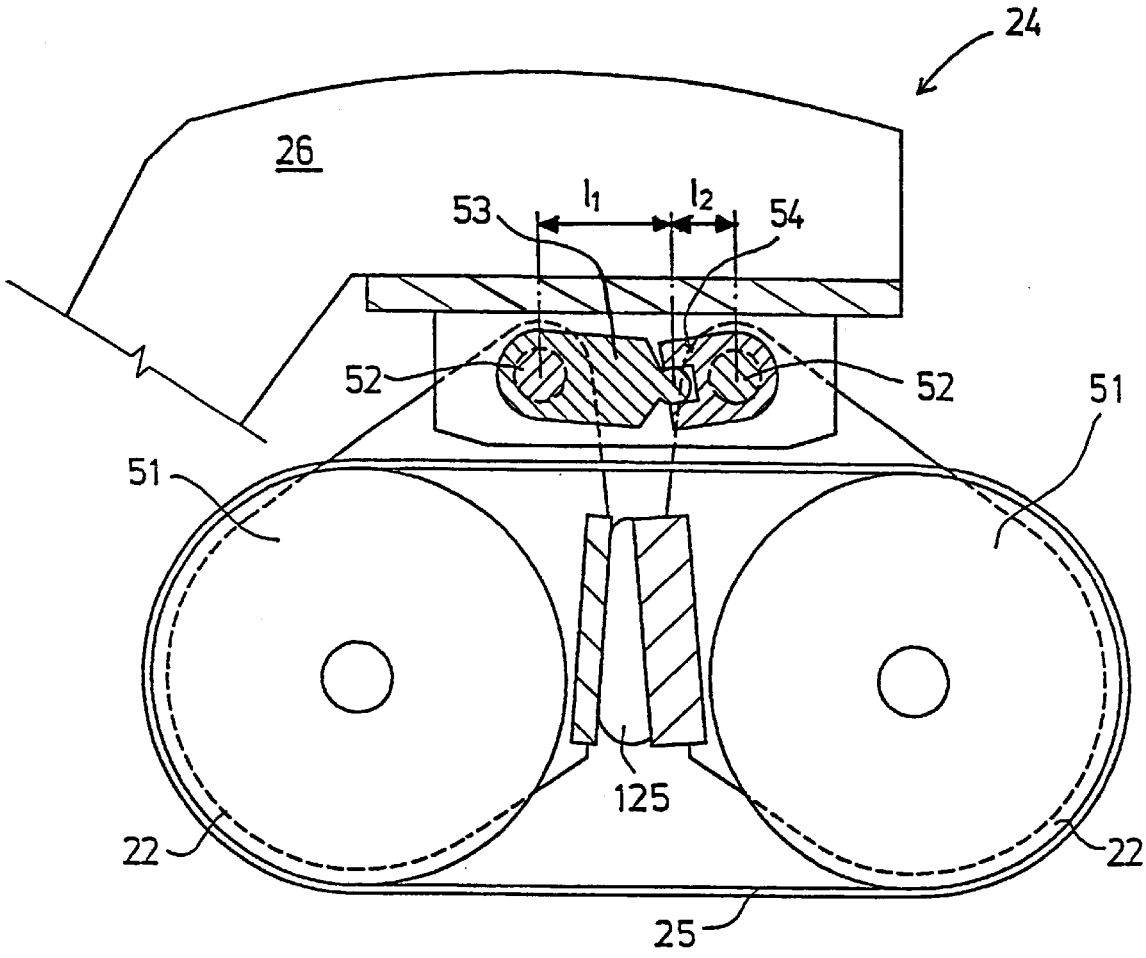
FIG. 2A is a schematic sectional view of the coupling together of the rolls in a rider roll unit.

FIG. 2A is a schematic sectional view of the coupling together of the rolls 22 in the loading and/or support unit 24. The rolls 22 have been mounted from both ends on arms 51, which have been arranged to be pivotal around shafts 52. One shaft 52 is provided with a coupling member 53, which has been fitted into a coupling member 54 connected with the other shaft 52. Thus, movements of rotation of the shafts 52 are interconnected, and the rolls 22 move in relation to one another as geometrically positively controlled. By means of the bellows 125, it is possible to control the mutual distance between the rolls 22.

In the embodiment shown in FIG. 2A, the articulation point between the coupling members 53, 54 is not halfway between the shafts 52, but $I_1>I_2$. This is why the rolls 22 move in relation to one another with the transmission ratio determined by the distances $I_1$, $I_2$. When the rolls 22 move asymmetrically in relation to one another, the contact point of the belt 25 with the roll 15 to be formed can be made asymmetric in relation to the centre line X—X between the rolls. By means of such an arrangement, in some situations, defects that are about to be formed in the roll 15 can be corrected.

Figure 2B:
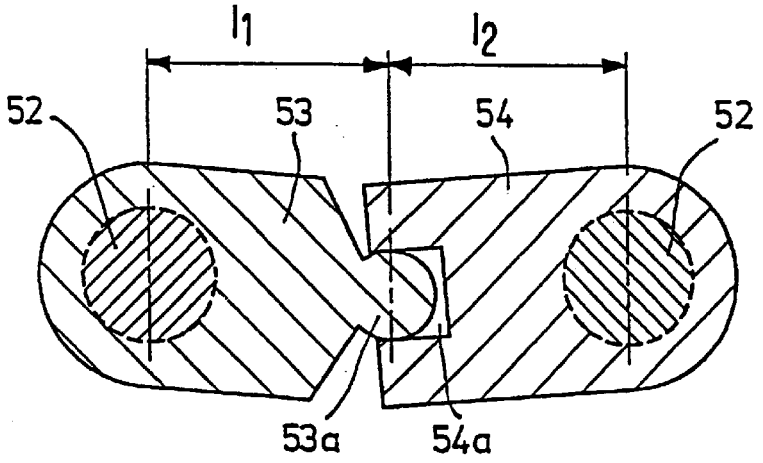
FIG. 2B is an enlarged view of the coupling members between the rolls as shown in FIG. 2A.

FIG. 2B illustrates the coupling between the pivot shafts 52 of the rolls 22 illustrated in FIG. 2A so that the coupling members 53, 54 produce a symmetric movement between the rolls 22. The articulation point between the coupling members 53, 54 is halfway on the straight line between the pivot shafts 52 of the rolls, so that $I_1=I_2$. In this favourable embodiment, the rolls move symmetrically in relation to one another. In the figure, the coupling members 53, 54 consist of a projection 53 attached to one shaft 52, the rounded head **53*a* of said projection being fitted to be positioned into the recess 54*a* provided at the end of the projection 54 attached to the other shaft 52. As the rolls 22 move symmetrically in relation to one another, the contact point of the belt 25 with the roll 15 to be formed can be kept constantly symmetric in relation to the plane X—X passing through the centre point of the straight line interconnecting the roll 22 centres and through the centre 14 of the roll 15** that is being formed.

The coupling means construction 53,54 described above constitutes a preferred solution, but the mutual coupling of the rolls 22 can, of course, also be accomplished in some other way. One possibility is to employ cogged wheels or segments of cogged wheels fixed to the shafts 52, whose teeth are coupled with one another.

Figure 3:
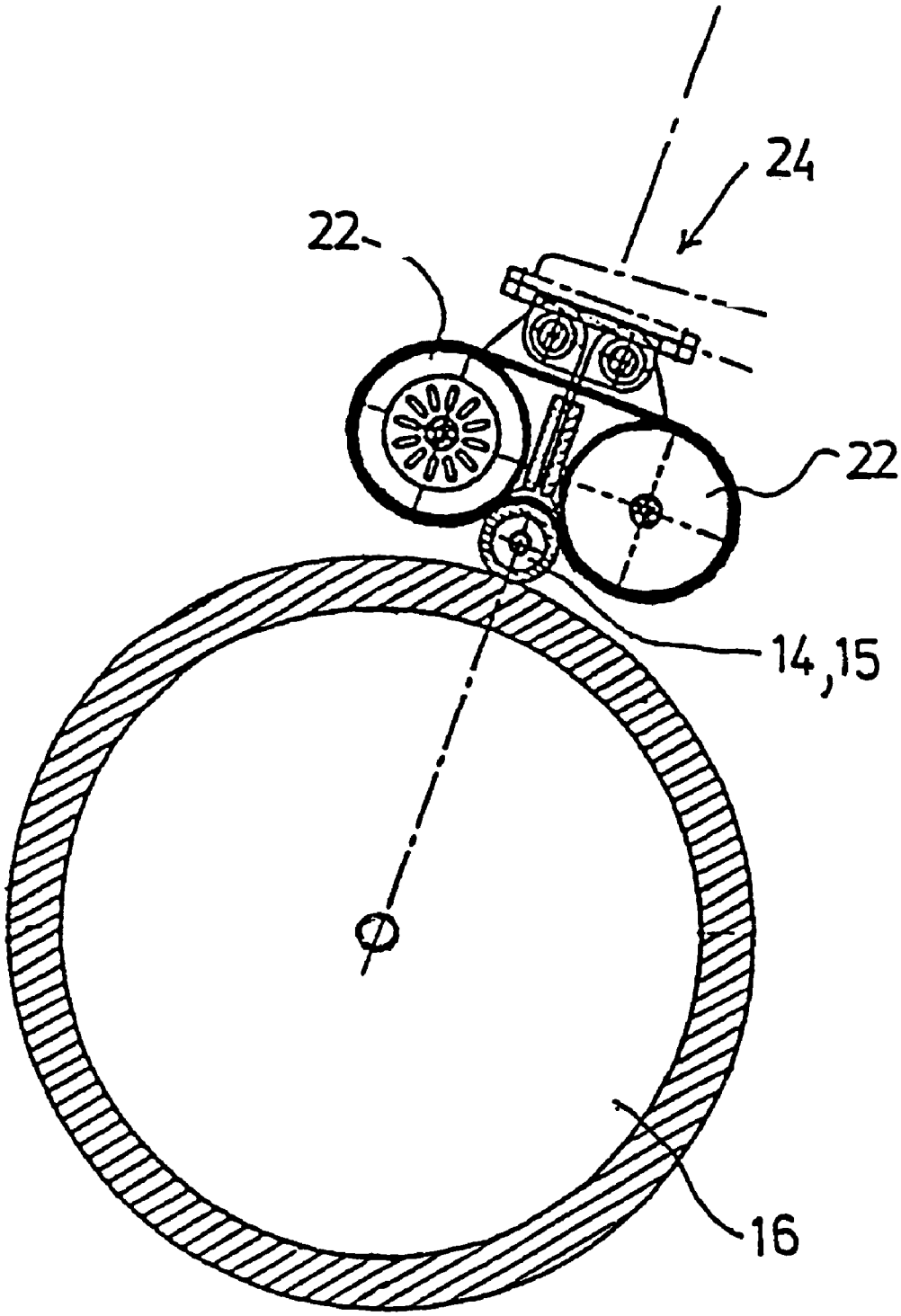
FIG. 3 illustrates the initial stage of winding.

FIG. 3 illustrates the initial stage of winding. The closed contact geometry necessary in the initial stage of winding is provided by means of the support roll 16 and the rolls 22 of the loading and/or support unit 24 by employing a belt tension that is little in comparison with the load applied by the loading and/or support unit 24 to the roll 15. In such a case, at the belt 25, at the rolls 22, a higher contact pressure is formed than on the remaining portion of the belt 25, and bending of the spool 14 and of the growing roll is prevented.

The loading and/or support unit 24 is most appropriately of invariable width, and for a wider roll a number of loading and/or support units 24 are used fitted side by side. In the initial stage of winding, the loading and/or support unit 24 prevents bending of the spool 14 by the effect of web tension. According to a preferred embodiment of the invention, the rolls 22 in the loading and/or support unit 24 are in a symmetric movement in relation to one another, whereby the movement is geometrically con-trolled. Thus, the winding gap remains in its place and the spool 14 cannot bend.

The coupling between the rolls 22 in the loading and/or support unit 24 is accomplished so that by means of a bellows 125 the distance between the rolls 22 can be varied, in which connection, when the distance between the rolls 22 is increased, the belt 25 that surrounds the rolls 22 is tensioned. After the distance between the rolls 22 has been increased to the desired value by means of the bellows 125, the rolls 22 are locked in this position and do not move on support of their articulated joints 52 by the effect of an outside force. This is why the rolls 22 in the loading/support unit 24 can be driven by a motor so that a drive is applied to the roll 15 faces.

In connection with the loading and/or support unit 24, it is possible to carry out measurement of force and, based on said measurement, regulation of the force and/or position of the loading and/or support unit 24 can be performed, as is described, for example, in the applicant's Finnish patent application "Method and device in winding of a web" to be filed on the same day.

In the following, the patent claims will be given, and the details of the invention may show variation within the scope of the inventive idea defined in said claims and differ from what has been stated above by way of example only.

What is claimed is:

1. A device in winding of a web, which device is fitted to be used when a web (W) is wound onto a spool (14) when supported by a support roll (16) and passing through a nip (N) formed between the support roll (16) and a roll (15) being produced, which spool (14) is at least partly supported by means of a support member placed in the center of the spool (14), said device comprising:

at least one loading and/or support unit (24) in order to support the spool and to load the roll (15) being produced, said loading and/or supporting unit (24) comprising at least two rolls (22), around which at least one belt (25) has been fitted in the axial direction of the rolls (22), wherein the rolls (22) in the loading and/or support unit (24) have been coupled together by coupling members (53,54) provided with an articulation point therebetween so that movements of the rolls (22) in relation to one another are geometrically positively controlled.

2. A device as claimed in claim 1, wherein the movement of the rolls (22) is symmetric in relation to a central axis (X—X) of the loading and/or support unit (24).

3. A device as claimed in claim 1, wherein the movements of both rolls (22) in relation to a central axis (X—X) of the loading and/or support unit (24) are of different magnitudes.

4. A device as claimed in claim 1, wherein the device comprises a number of loading and/or support units (24) which have been placed side by side in the direction of width of the roll (15) being produced.

5. A device as claimed in claim 1, wherein the rolls (22) in the loading and/or support unit (24) have been mounted from both ends on arms (51), which have been fitted to be pivotal around shafts (52), and that one shaft (52) is provided with a projection (53) operating as a coupling member and fitted in a projection (54), which is connected with the other shaft (52) and which operates as a coupling member, in order to couple the movements of rotation of the shafts (52) and, thus, also the movements of rotation of the rolls (22) with one another.

6. A device as claimed in claim 5, wherein the articulation point between said projections (53,54) is placed on a centre line (X—X) between the rolls (22) in the loading and/or support unit (24), in which case the rolls (22) move synchronously in relation to the centre line (X—X).

7. A device for supporting a spool onto which a web is being wound, said device comprising:

at least one support unit comprising a first and second roll, a belt fitted around said rolls in an axial direction, means for coupling said first roll to said second roll so that said first and second rolls are moveable with respect to one another at a predetermined geometric ratio, and means for selectively controlling the movement of said first and second rolls.

8. A device according to claim 7, wherein said predetermined geometric ratio is not one to one so that the movement of said first and second rolls relative to one another is asymmetrical.

9. A device according to claim 7, wherein said device comprises a plurality of said support units arranged side by side along a width of said spool.

10. A device according to claim 7, wherein said means for coupling said first roll to said second roll comprises a first and second pair of arms, each one of said first pair of arms secured to a respective end of said first roll at a first end of said arm and to a first pivot shaft at a second end, each one of said second pair of arms secured to a respective end of said second roll at a first end of said arm and to a second pivot shaft at a second end of said arm.

11. A device according to claim 10, wherein said means for coupling said first roll to said second roll further comprises a first coupling member extending from said first pivot shaft and a second coupling member extending from said second pivot shaft, said first and second coupling members being structured and arranged so that they articulate with respect to one another.

12. A device according to claim 11, wherein said first coupling member has a first selected length and said second coupling member has a second selected length, said first and second selected lengths defining said predetermined geometric ratio.

13. A device according to claim 12, wherein said first and second coupling members articulate at an articulation point arranged at a center line (X—X) between said first and second rolls.

* * * * *